US005286128A

United States Patent [19]

Gillum

[11] Patent Number: 5,286,128

[45] Date of Patent: Feb. 15, 1994

[54] RING BINDER

[75] Inventor: Steven Gillum, Fairhaven, Mass.

[73] Assignee: U.S. Ring Binder, New Bedford, Mass.

[21] Appl. No.: 950,017

[22] Filed: Sep. 24, 1992

[51] Int. Cl.[5] ..... B42F 3/04

[52] U.S. Cl. ..... 402/39; 402/31; 402/36

[58] Field of Search ..... 402/31, 34, 39, 41, 402/38

[56] References Cited

U.S. PATENT DOCUMENTS

| | | | |
|---|---|---|---|
| 959,849 | 5/1910 | Forgerson . | |
| 1,299,276 | 4/1919 | Whitlock | 402/34 |
| 1,481,342 | 1/1924 | Blackwell et al. . | |
| 1,865,098 | 6/1932 | Green . | |
| 2,017,188 | 10/1935 | Tannehill . | |
| 3,270,749 | 9/1966 | O'Connell . | |
| 4,368,995 | 1/1983 | Cohen . | |
| 4,552,478 | 11/1985 | Cohen . | |
| 4,624,595 | 11/1986 | Ohminato | 402/31 X |
| 4,798,491 | 1/1989 | Lassle | 402/34 |
| 4,824,434 | 6/1989 | Ferreira-Godinho . | |
| 4,828,421 | 5/1989 | Arakaki . | |
| 5,106,222 | 4/1992 | D'Amore . | |

FOREIGN PATENT DOCUMENTS

| | | |
|---|---|---|
| 2221924 | 10/1974 | France . |
| 2004816 | 4/1979 | United Kingdom . |

*Primary Examiner*—Mark Rosenbaum
*Assistant Examiner*—Willmon Fridie, Jr.
*Attorney, Agent, or Firm*—Hill, Steadman & Simpson

[57] ABSTRACT

A shield for a ring metal is provided having arcuate band sections at the locations of the rings and intermediate sections therebetween, the intermediate sections having a straight segmental cross section having a lower overhead clearance between the shield and the hinged leaves than the band sections. The hinged leaves abut the intermediate section before tab members formed on said hinged leaves can abut an underside of the band sections, thus upward dents are prevented on the shield. Additionally, the straight segmental configuration of the intermediate sections provides increased resiliency for opening and holding closed the rings of the ring metal.

19 Claims, 3 Drawing Sheets

RING BINDER

BACKGROUND OF THE INVENTION

The present invention relates to a ring carrier or "ring metal" for holding pages to a spine of a ring binder. In particular, the invention relates to a ring metal having a flexible cover sheet with diversely shaped regions along its length.

In a conventional ring binder a plurality of openable circular rings are arranged along a length of a ring metal which itself is secured to a spine or side panel of the cover of the ring binder. The rings are attached at their base ends to a respective one of a pair of hinged leaves which conform to a cross sectional "V" shape. At a central intersection between the two hinged leaves the hinge leaves provide interlacing tabs which prevent the leaves from becoming separated. Syrrounding the hinged leaves and extending the length of the ring metal is a resilient arcuate cover portion or "shield" having hooked lateral edge portion which clamp the hinged leaves into either an upright V configuration when the rings are open or a downward V configuration when the rings are closed. The resilient clasping of the shield provides for a "snapping" between the ring open and ring closed positions. Additionally, this resiliency holds the rings in a closed condition during usage.

It is a problem in designing ring binders that the interlacing tabs associated with the V-shaped leaves can overextend upwardly and foul or dent the shield from beneath, especially if the rings are forcibly spread apart.

It is known in the prior art to provide on the shield, between the rings along the length of the shield, a dimple or a downward indentation which creates an upward displacement stop for the hinged leaves. This stop is sized to limit the upward movement of the V-shaped hinged leaves to that position which prevents contact of the tabs with the underside of the shield. Such a design is disclosed in U.S. Pat. No. 4,552,478.

A re-enforced cover member having longitudinally arranged arcuate sections connected to, overlapping or blended into polygonal cross sections is not shown.

SUMMARY OF THE INVENTION

It is an object of the present invention to provide an easily assembled ring metal for a ring binder which also provides a sturdy and reliable mechanism for opening and closing the rings associated therewith.

The objects are inventively achieved in a ring metal for a ring binder having varied cross sectional profiles along an axial length of the ring metal. Between rings a segmental or polygonal arch section is arranged, and at each ring an arcuate arch section or band section is provided. The segmental arch section maintains a lower vertical clearance than the arcuate arch sections thereby limiting the upward displacement of V-shaped hinged leaves when the rings are opened. Thus, by limiting the overhead height for the V-shaped hinged leaves, the tabs associated with the conventional hinged leaves which are axially located in the arcuate arched sections, stop short of fouling the arcuate arched sections when the rings are opened. Thus, the tabs cannot puncture or otherwise push against the arcuate arch section of the binder.

By immediately transitioning from the arcuate arch section to the polygonal section a rib is created at that location which strengthens the cover across the width of the cover which improves the tension of the finished binder.

During assembly, before the hooked lateral edges are formed, the shield extends downwardly in two parallel straight edge portions or "legs". The hinged leaves are placed within the shield and then the legs are bent inwardly to form the hooked lateral edge portions. It is advantageous to maintain these legs in parallel orientation during assembly. The ribs add rigidity to the shield and keep the legs parallel, therefore easing the assembly process.

DETAILED DESCRIPTION OF THE PREFERRED EMBODIMENTS

Figure 1:
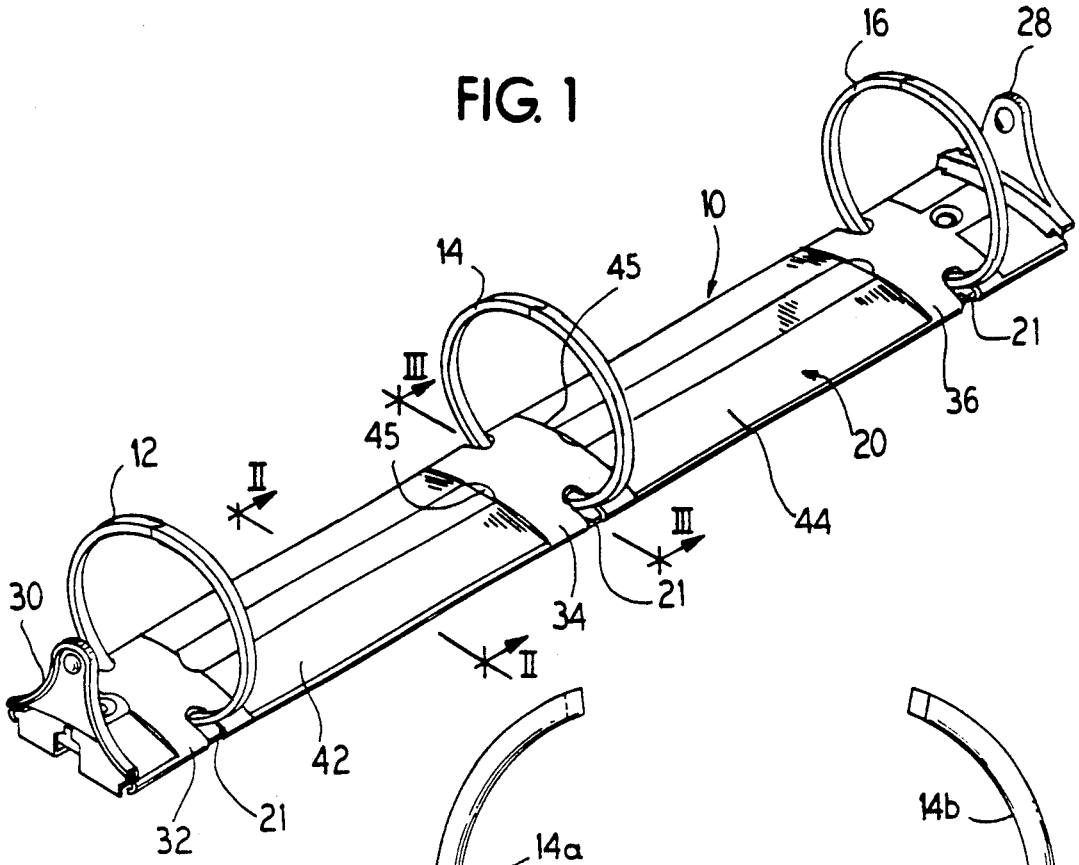
FIG. 1 is a perspective view of a ring metal of the present invention.

FIG. 1 shows a "ring metal" or a ring carrier 10 of the present invention. The ring metal is normally attached to a spine portion or a side cover portion of a loose leaf ring binder. The ring metal holds a plurality of openable rings 12, 14, 16 arranged axially along the metal. The rings penetrate at a base end through a cover 20 at notches 21 and are attached to hinged leaves 22, 24 shown in FIG. 2. Mounted on opposite ends of the ring metal are release levers 28, 30 which can be rotated to force the hinged leaves into an upward V configuration or forced the hinged leaves into a downward V configuration. The operation of the leaves 22, 24 and the levers 28, 30 is described in U.S. Pat. No. 5,116,157, issued May 26, 1992.

The shield 20 of the invention comprises, in the preferred embodiment, five regions. At the location of each ring 12, 14, 16 the shield has an arcuate cross section at the bands 32, 34, 36. Between the bands the shield comprises segmental or polygonal cross sections at the intermediate sections 42, 44. In the preferred embodiments the bands 32, 34, 36 immediately transition into the adjacent intermediate sections 42, 44 respectively. This can be accomplished in a stamping operation. The immediate transition or discontinuity creates ribs 45 which strengthen the shield 20 in a widthwise direction.

Figure 2:
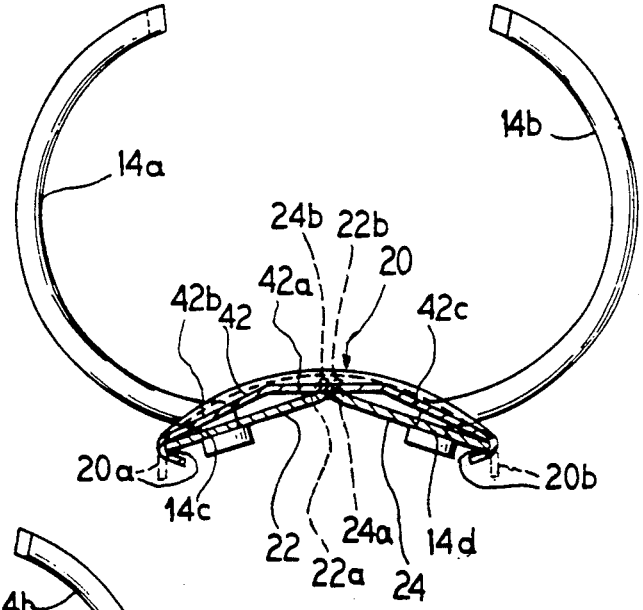
FIG. 2 is a sectional view taken generally along II—II of FIG. 1.

FIG. 2 shows the opened ring 14 having ring halves 14*a*, 14*b* attached at base ends 14*c*, 14*d* to the hinged leaves 22, 24 respectively. In the configuration of FIG. 2 the hinged leaves have been forced in an upward V shape. The hinged leaves 22, 24 are resiliently clasped by the shield 20 which has hooked lateral edge portions 20*a*, 20*b* which surround outside lateral sides of the hinged leaves 22, 24. Before the edge portions 20*a*, 20*b* are formed they are directed straight down as legs 20*a*, 20*b*, shown dashed. This allows space for the installation of the hinged leaves 22, 24. During assembly the ribs 45 add stiffness to the shield to help retain the legs 20*a*, 20*b* in a parallel orientation. A top portion 22*a*, 24*a* respectively of the hinged leaves 22, 24 abuts a top segment 42*a* of the intermediate section 42 when the rings are opened. The intermediate section 42 comprises the top segment 42*a* and opposite side segments 42*b* and 42*c* in a polygonal or straight line segmental configuration. The intermediate section 44 is identical.

Figure 3:
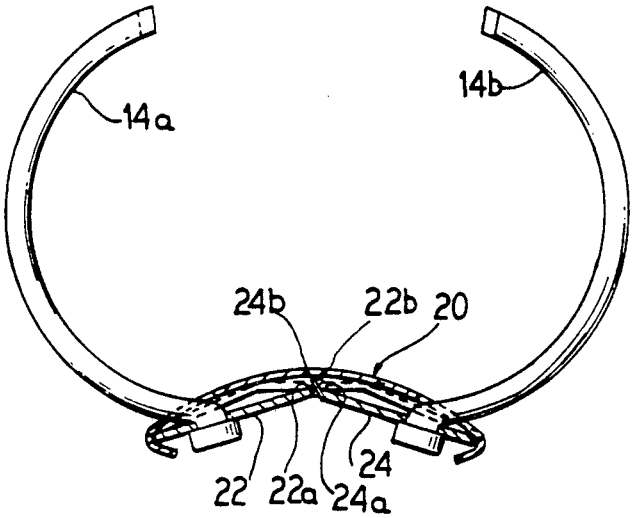
FIG. 3 is a sectional view taken generally along III—III of FIG. 1.

Typical for hinged leaf construction are interlacing tabs 22*b*, 24*b* respectively which prevent the hinged leaves from separating at their interface. In the invention, these tabs can be located in the band sections 32, 34, and 36. As pointed out as a problem in the prior art, when the rings are stretched open under some force these tabs 22*b*, 24*b* can sometimes dent the shield 20 from beneath. As a part of the present invention, when the upper portions 22*a*, 24*a* land on the top segment 42*a* the tabs 22*b*, 24*b*, which are located in the arcuate bands 32, 34, 36, fall short or striking the arcuate bands 32, 34, 36 and thus denting is prevented. This is further demonstrated with reference to FIG. 3.

Figure 4:
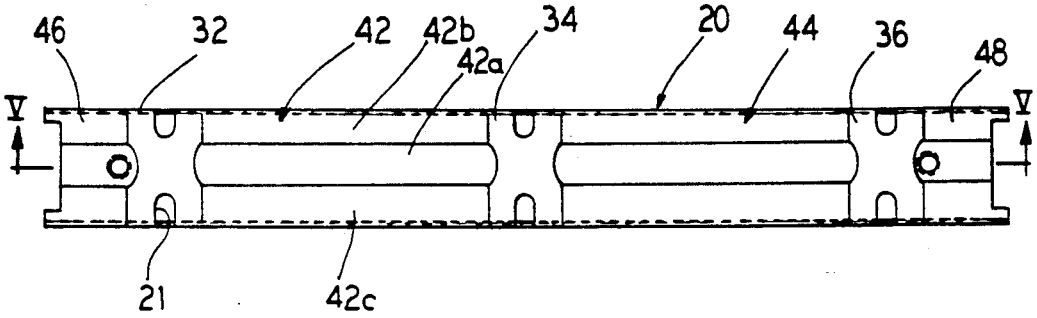
FIG. 4 is a top view of a shield of the ring metal of FIG. 1.
Figure 5:
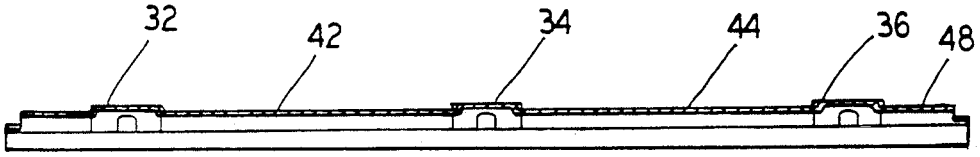
FIG. 5 is a sectional view taken generally along V—V of FIG. 4.

FIG. 4 and FIG. 5 show in plan view and sectional view the arrangement of the shield 20 shown in FIG. 1. In this section the outer bands 32, 36 immediately transition into sixth and seventh outer sections, 46, 48 which also have polygonal cross sections.

Figure 6:
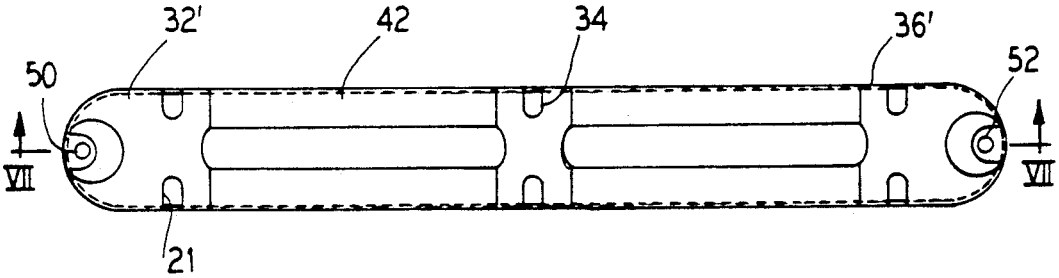
FIG. 6 is a top plan view of a alternate embodiment of a shield.
Figure 7:
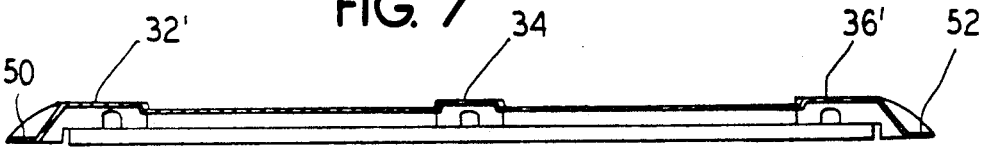
FIG. 7 is a sectional view taken generally along line VII—VIII of FIG. 6.

FIG. 6 and FIG. 7 show an alternate embodiment of a shield 20' in plan and sectional view where the outer bands 32, 36 and sixth and seventh outer sections 46, 48 of FIG. 4 have been replaced by rounded arcuate bands 32', 36' extending outwardly to the edge of the shield 20' and which transition down to rounded apertures 50, 52 for attaching the ring metal to the binder, such as by rivets.

Figure 8:
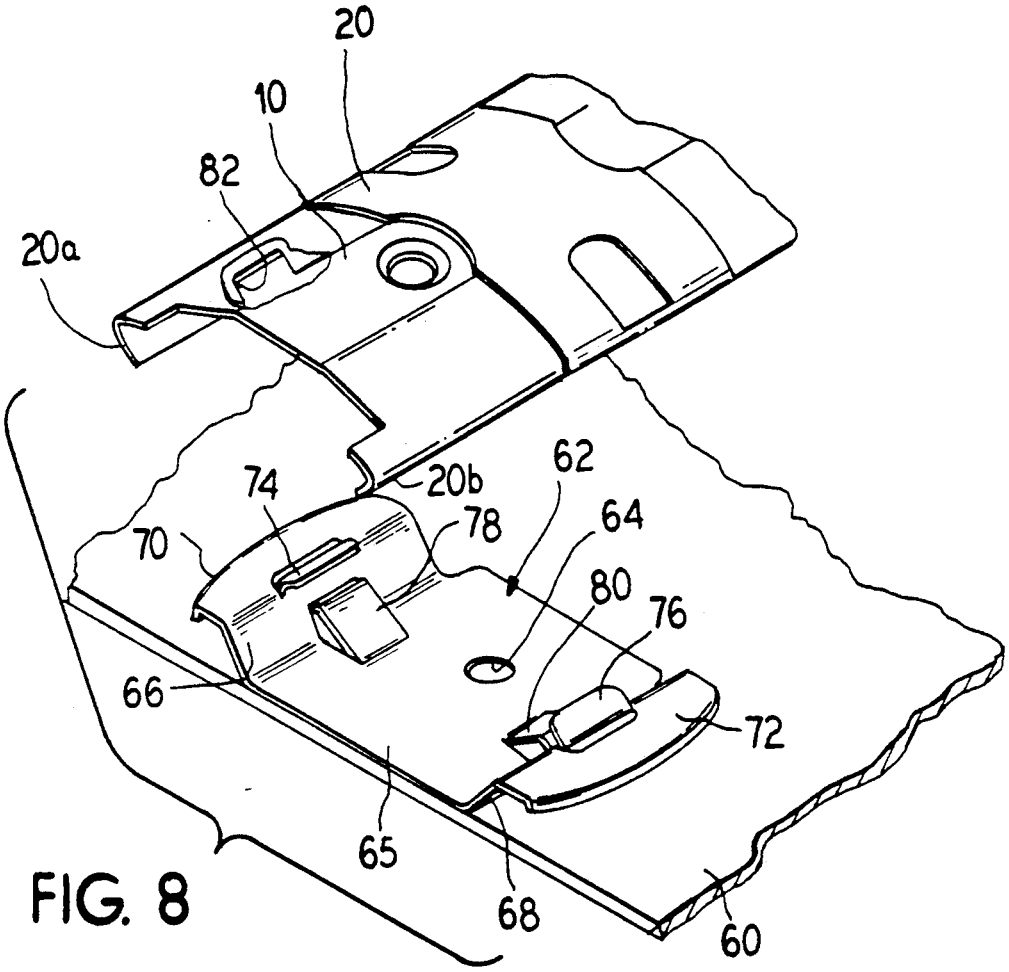
FIG. 8 is a partial exploded view of a spring clip and the shield of FIG. 1.

FIG. 8 shows an advantageous method of attaching the ring metal 10 to a binder cover 60. A steel spring clip 62, or a plurality of such clips, is used. The spring clip 62 is riveted to the cover 60 at an aperture 64 through a base 65. The clip has lateral side walls 66, 68 extending upward from the base 65. The side walls 66, 68 are bent off outwardly in release levers 70, 72. The side walls 66, 68 also have tabs 74, 76 cut and bent therefrom inwardly which, when the metal 10 is installed overlie the shield 20, hold the metal 10 to the cover 60. The base and side walls also have locator tabs 78, 80 cut and bent therefrom which register with locator notches 82, 84 located in opposite hooked lateral edge portions 20*a*, 20*b* (84 not shown but located in hooked lateral edge portion 20*b* opposite notch 82).

To install the ring metal 10, the release levers 70, 72 are depressed, thus separating the tabs 74, 76. The ring metal 10 is pressed onto the clip 62 with the locator tabs 78, 80 registering with the locator notches 82, 84. The levers are released and the tabs 74, 76 spring over the shield 20.

Although the present invention has been described with reference to a specific embodiment, those of skill in the art will recognize that changes may be made thereto without the departing from the scope and sprite of the invention as set forth in the appended claims.

I claim as my invention:

1. A shield for a ring metal for a ring binder, the ring metal having hinged leaves covered by and resiliently clasped by said shield, said hinged leaves attached to openable sections of a ring for holding paper thereon, the shield comprising:

a first arcuate section located at the axial location of said ring; and a first segmental section and a second segmental section having polygonal cross sections taken through a width of the shield and arranged connected to said first arcuate section on opposite longitudinal side of said arcuate section;

wherein said hinged leaves comprise tabs located under said first arcuate cross section, said first arcuate cross section and one of said polygonal cross sections adapted for said hinged leaves to abut said one polygonal cross section leaving a clearance remaining between said tabs and said first arcuate cross section.

2. The shield according to claim 1 wherein one of said segmental sections is shaped to provide a smaller overhead clearance from said hinged leaves than a clearance between said first arcuate cross section and said hinged leaves.

3. The shield according to claim 1, comprising a second arcuate section and a third arcuate section, said first segmental section arranged between and connected to the first and second arcuate cross section and the second segmental section arranged between and connected to the first and third arcuate cross section respectively.

4. The shield according to claim 3 further comprising fourth and fifth segmental sections having polygonal cross sections, said fourth segmental section arranged on an outside of and connected to said second arcuate section and said fifth segmental section arranged on an outside of and connected to said third arcuate section.

5. The shield according to claim 3, wherein said second and third arcuate sections have rounded outside axial ends.

6. The shield according to claim 1, wherein said polygonal cross sections comprise a flat top segment and two inclined lateral segments.

7. A ring carrier for a ring binder comprising:

a plurality of pivotably openable rings;

a first leaf and a second leaf hingedly abutted together along one common lateral edge;

a resilient cover resiliently surrounding said first leaf and said second leaf;

each of said rings having two base ends, each base end connected to one of said leaves such that a pivoting upward of said leaves toward said cover in an upward V formation opens said rings, and a pivoting downward of said hinged leaves results in a closing of said rings; and said cover comprises band sections at each of said rings along an axis of said cover, and intermediate sections between said band sections along an axis of said cover, said band sections having a taller height from said hinged leaves than said intermediate sections, said intermediate sections comprising a segmental cross section having planar side segments.

8. The ring carrier according to claim 7 wherein said band sections comprise arcuate cross sections.

9. The ring carrier according to claim 7 wherein said first and second leaves comprise interlacing tabs located in the band section of said cover and said first and second leaves abut said intermediate section upon opening, said rings leaving a clearance remaining between said tabs and said band sections.

10. The ring carrier according to claim 7, wherein said intermediate sections comprise a straight top segment and two inclined side segments connected together by said top segment.

11. The ring carrier according to claim 10, wherein said side segments terminate in curled edges to engage outside lateral edges of said first and second leaves.

12. The ring carrier according to claim 7, wherein said band sections provide notches on opposite lateral sides for penetration of said ring therethrough.

13. A ring carrier for a ring binder comprising:

a plurality of pivotably openable rings;

a first leaf and a second leaf hingedly abutted together along one common lateral edge;

a resilient cover resiliently surrounding said first leaf and said second leaf;

each of said rings having two base ends, each base end connected to one of said leaves such that a pivoting upward of said leaves toward said cover in an upward V formation opens said rings, and a pivoting downward of said hinged leaves results in a closing of said rings; and said cover comprises band sections at each of said rings along an axis of said cover, and intermediate sections between said band sections along an axis of said cover, said band sections and said intermediate sections having divergent cross sectional shapes, said band section immediately transitioning into said intermediate sections creating a stiffening rib across a width of said cover.

14. The ring carrier according to claim 13, wherein said resilient cover has lateral edges bent inwardly to form hooks for surrounding said first leaf and said second leaf.

15. The ring carrier according to claim 13, wherein said bands comprise an arcuate cross section and said intermediate sections comprise segmental cross sections.

16. The ring carrier according to claim 15, wherein each of said intermediate sections comprises a horizontal segment and two lateral inclined side segments connected together by said horizontal segment.

17. The ring carrier according to claim 16, wherein said horizontal segment has a lower clearance to said first and second leaves than said band sections.

18. The ring carrier according to claim 16 further comprising a first outside section and a second outside section, said first outside section arranged connected to a band section at one axial end and said second outside section connected to a band section at a respective opposite axial end of said ring carrier, said first and second outside sections having segmental cross sections.

19. The ring carrier according to claim 17, wherein the band sections adjacent each axial end of the ring carrier have rounded outside edges.

* * * * *